US012486631B2

(12) United States Patent
Rich

(10) Patent No.: US 12,486,631 B2
(45) **Date of Patent: *Dec. 2, 2025**

(54) SNOW REMOVAL SYSTEM

(71) Applicant: THE TORO COMPANY, Bloomington, MN (US)

(72) Inventor: Thomas M. Rich, Lebanon, IN (US)

(73) Assignee: THE TORO COMPANY, Bloomington, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/948,121

(22) Filed: Nov. 14, 2024

(65) Prior Publication Data

US 2025/0327256 A1 Oct. 23, 2025

Related U.S. Application Data

(63) Continuation of application No. 18/205,360, filed on Jun. 2, 2023, which is a continuation of application No. 17/680,648, filed on Feb. 25, 2022, now Pat. No. 11,686,057, which is a continuation of application No. 16/591,976, filed on Oct. 3, 2019, now Pat. No. 11,261,573, which is a continuation of application No. 15/058,243, filed on Mar. 2, 2016, now Pat. No. 10,472,783.

(51) Int. Cl.
*E01H 5/06* (2006.01)
*E01H 10/00* (2006.01)

(52) U.S. Cl.
CPC ..... *E01H 5/061* (2013.01); *E01H 5/062* (2013.01); *E01H 10/007* (2013.01)

(58) Field of Classification Search
CPC ..... E01H 5/06; E01H 5/061; E01H 5/062; E01H 10/007; B62D 51/02
See application file for complete search history.

(56) References Cited

U.S. PATENT DOCUMENTS 3,065,556 A * 11/1962 Kampert ..... E01H 5/066 37/408
3,587,182 A * 6/1971 Hirt ..... E01H 5/063 37/270

(Continued)

FOREIGN PATENT DOCUMENTS

CH 702870 B1 11/2014
EP 2639358 A1 9/2013

OTHER PUBLICATIONS

Non-Final Office Action for U.S. Appl. No. 15/058,243, dated Mar. 18, 2019.

(Continued)

*Primary Examiner* — Jamie L Mcgowan
(74) *Attorney, Agent, or Firm* — MARSHALL, GERSTEIN & BORUN LLP

(57) ABSTRACT

A snow plow is pivotally mounted to a tractor by a compound mount allowing for multiple blade positions. The mount has an inner portion pivotally mounted about a first horizontal axis to the front of the tractor and an outer portion pivotally mounted about a vertical axis to the inner portion. The plow blade is pivotally mounted about a second horizontal axis to the outer portion. Deicer nozzles spray liquid and a spreader distributes salt and other materials in front of the front wheels of the tractor.

27 Claims, 6 Drawing Sheets

(56) References Cited

U.S. PATENT DOCUMENTS 4,074,448 A * 2/1978 Niemela ..... E01H 5/065 37/234
4,491,275 A * 1/1985 Holsworth ..... E01H 5/06 222/609
4,552,226 A * 11/1985 Platter ..... E02F 3/815 172/815
4,597,468 A 7/1986 Friedrich
5,082,065 A 1/1992 Fletcher
5,333,795 A * 8/1994 Jessen ..... A01C 15/02 239/685
5,447,204 A 9/1995 Asal et al.
5,638,618 A 6/1997 Niemela et al.
5,706,591 A 1/1998 Wissmiller
5,950,336 A * 9/1999 Liebl ..... E01H 5/06 37/231
6,050,008 A * 4/2000 Doornek ..... E01H 5/066 37/231
6,173,590 B1 1/2001 Witchey
6,173,904 B1 1/2001 Doherty et al.
6,276,075 B1 * 8/2001 Kost ..... E01H 5/06 37/231
6,446,879 B1 * 9/2002 Kime ..... E01C 19/203 239/7
6,830,111 B2 * 12/2004 Page ..... E02F 9/02 414/686
6,941,685 B2 9/2005 Goy et al.
7,028,423 B1 4/2006 Curry
7,043,890 B2 5/2006 Lofton
7,137,214 B2 11/2006 Hoerle et al.
7,219,453 B2 * 5/2007 Baker ..... E01H 5/06 37/232
7,448,453 B2 * 11/2008 Tobin ..... E02F 3/7631 172/828
7,788,829 B2 9/2010 Stephan
7,941,947 B2 5/2011 Stephan
7,975,407 B2 * 7/2011 Dilworth ..... E01H 5/06 37/231
7,980,569 B2 7/2011 Azure et al.
8,146,844 B2 4/2012 Kisenwether
8,191,288 B2 6/2012 Weagley et al.
8,465,073 B2 6/2013 Roeder
8,517,138 B2 8/2013 Sashikuma et al.
8,621,769 B2 1/2014 Weagley et al.
8,695,238 B2 * 4/2014 Warchola ..... E01H 5/063 37/234
8,732,989 B1 * 5/2014 Turnbull ..... E01H 5/066 37/270
9,080,297 B2 7/2015 Hanson
9,592,862 B2 * 3/2017 Pugh ..... B62D 49/0614
D785,680 S 5/2017 Dipino
9,976,267 B2 5/2018 Steiner
10,472,783 B2 11/2019 Rich
10,486,616 B2 * 11/2019 Lauziere ..... B60R 11/06
10,801,172 B2 * 10/2020 Moorman ..... E01H 5/066
2002/0073581 A1 6/2002 Takeuchi
2002/0189435 A1 * 12/2002 Domann ..... E02F 9/2275 91/459
2004/0018078 A1 * 1/2004 Vicars, III ..... E02F 3/3405 414/685
2004/0145134 A1 * 7/2004 Bares ..... E02F 9/166 280/32.7
2005/0189432 A1 9/2005 Kime
2005/0193597 A1 9/2005 Sutton et al.
2005/0246088 A1 11/2005 Doherty et al.
2007/0132204 A1 * 6/2007 Sewell ..... A01B 51/026 280/418
2008/0197588 A1 * 8/2008 Azure ..... B62D 51/02 180/9.1
2009/0078488 A1 * 3/2009 Bock ..... E02F 9/2267 180/305
2009/0081017 A1 * 3/2009 Bock ..... E02F 9/2004 414/640
2009/0307938 A1 12/2009 Koch et al.
2009/0307942 A1 12/2009 Gamble, II et al.
2010/0064555 A1 3/2010 Stephan
2010/0131157 A1 5/2010 Kahle et al.
2014/0174838 A1 * 6/2014 Oswald ..... B60K 17/28 180/215
2015/0083447 A1 3/2015 Lewis
2016/0021823 A1 * 1/2016 Hoppel ..... E02F 3/3677 280/98
2016/0138233 A1 5/2016 Barker et al.
2018/0346007 A1 * 12/2018 Fielder ..... B62B 5/0069

OTHER PUBLICATIONS

Non-Final Office Action for U.S. Appl. No. 15/058,243, dated Apr. 4, 2018.
Non-Final Office Action for U.S. Appl. No. 15/058,243, dated Apr. 21, 2017.
Final Office Action for U.S. Appl. No. 15/058,243, dated Sep. 14, 2017.
Final Office Action for U.S. Appl. No. 15/058,243, dated Nov. 30, 2018.
Non-Final Office Action for U.S. Appl. No. 16/591,976, dated Mar. 8, 2021.
Non-Final Office Action for U.S. Appl. No. 16/591,976, dated Sep. 15, 2021.
Sutter 300 Mini Trail Dozer™. Website [online]. Sutter Equipment Company, Inc. Retrieved on Jun. 16, 2022 from the Internet: <URL: <https://www.sutterequipment.com/sutter-300>>.
YouTube® video of Sutter 300 Mini Trail Dozer™. Website [online]. Posted to YouTube on May 28, 2013. Retrieved on Jun. 16, 2022 from: <URL: <https://www.youtube.com/watch?v=KPH1XFWbgAs>>.

* cited by examiner

SNOW REMOVAL SYSTEM

CROSS-REFERENCE TO RELATED APPLICATIONS

This is a continuation of U.S. patent application Ser. No. 18/205,360, filed Jun. 2, 2023, which is a continuation of U.S. patent application Ser. No. 17/680,648, filed Feb. 25, 2022, which is a continuation of U.S. patent application Ser. No. 16/591,976, filed Oct. 3, 2019, which is a continuation of U.S. patent application Ser. No. 15/058,243, filed Mar. 2, 2016. The entirety of U.S. patent application Ser. No. 15/058,243, U.S. patent application Ser. No. 16/591,976, U.S. patent application Ser. No. 17/680,648, and U.S. patent application Ser. No. 18/205,360 is expressly incorporated by reference herein.

BACKGROUND OF THE INVENTION

Field of the Invention

The present invention relates generally to the field of vehicles and plows for removing snow from a supporting surface.

Description of the Prior Art

Snow is removed from streets and highways by trucks and other large vehicles having a snow plow mounted to the front end thereof. The snow plow includes a blade that may be lowered against the pavement or raised upwardly when not being used for plowing. Further, the blade may be tilted towards the side of the street thereby pushing the snow off the street or other roadway. A variety of mounting structures are used to secure the snow blade to the front of the truck.

Snow must also be removed from relatively narrow driveways, paths and other walkways. The large trucks and plow blades are not readily adaptable for use when the path is relatively narrow. I have therefore devised a blade and mounting structure coupled to a small tractor. A small sized tractor, known by the trademark "BOBCAT", is available from Clark Equipment Company and is particularly adaptable for such use.

Commercially available small sized tractors include four wheel drive system coupled with a skid steer transmission whereby the wheels on one side of the tractor are motionless while the wheels on the opposite side rotate thereby allowing the tractor to turn and move in a very constricted space. The snow plow and mounting arrangement disclosed herein is designed to be particularly useful when coupled to such a tractor.

Further, I have added to the tractor a spreader for distributing snow melting solids, such as, salt, along with a liquid spray system to dispense snow and ice melting liquids and other mixtures with both being located at the front end of the tractor providing for increased traction.

SUMMARY OF THE INVENTION

The preferred embodiment of the present invention is a snow blade for removably mounting to a vehicle having a front end and a rear end with the vehicle having a first side and an opposite second side extending from the front end to the rear end. A compound blade mount is mounted with a proximal end portion pivotally mountable about a first horizontal axis to the front end of the vehicle and including a distal end portion pivotally mounted about a second horizontal axis to the blade. The proximal end portion is separate from the distal end portion but is pivotably connected about a vertical axis to the distal end portion allowing the distal end portion to separately pivot about the vertical axis toward the first side and the second side of the vehicle. A first spring is connected to the blade mount and the vehicle and normally biases the blade to an upward transport position apart from the supporting surface but yieldable to allow the blade to move to a down position against the supporting surface and to further move to a float position. A yaw hydraulic cylinder is connected to the distal end portion and the proximal end portion to pivot the distal end portion relative to the proximal end portion separately moving the blade at an angle relative to the first side of the vehicle frame to push the snow toward the first side of the vehicle frame and moving the blade at an angle relative to the second side of the vehicle frame to push the snow toward the second side of the vehicle frame. A pitch hydraulic cylinder is connected to the proximal end portion and the vehicle frame to separately move the blade vertically positioning the blade in the down position, the transport position, and the float position.

It is an object of the present invention to provide a new and improved snow plow and mounting means for coupling to a four wheel drive, skid steer snow vehicle.

A further object of the present invention is to provide a snow plow and mounting structure for coupling to a vehicle.

An additional object of the present invention is to provide a snow machine having improved means for plowing snow and dispensing materials to melt snow and ice.

Related objects and advantages of the present invention will be apparent from the following description.

DESCRIPTION OF THE PREFERRED EMBODIMENT

Figure 1:
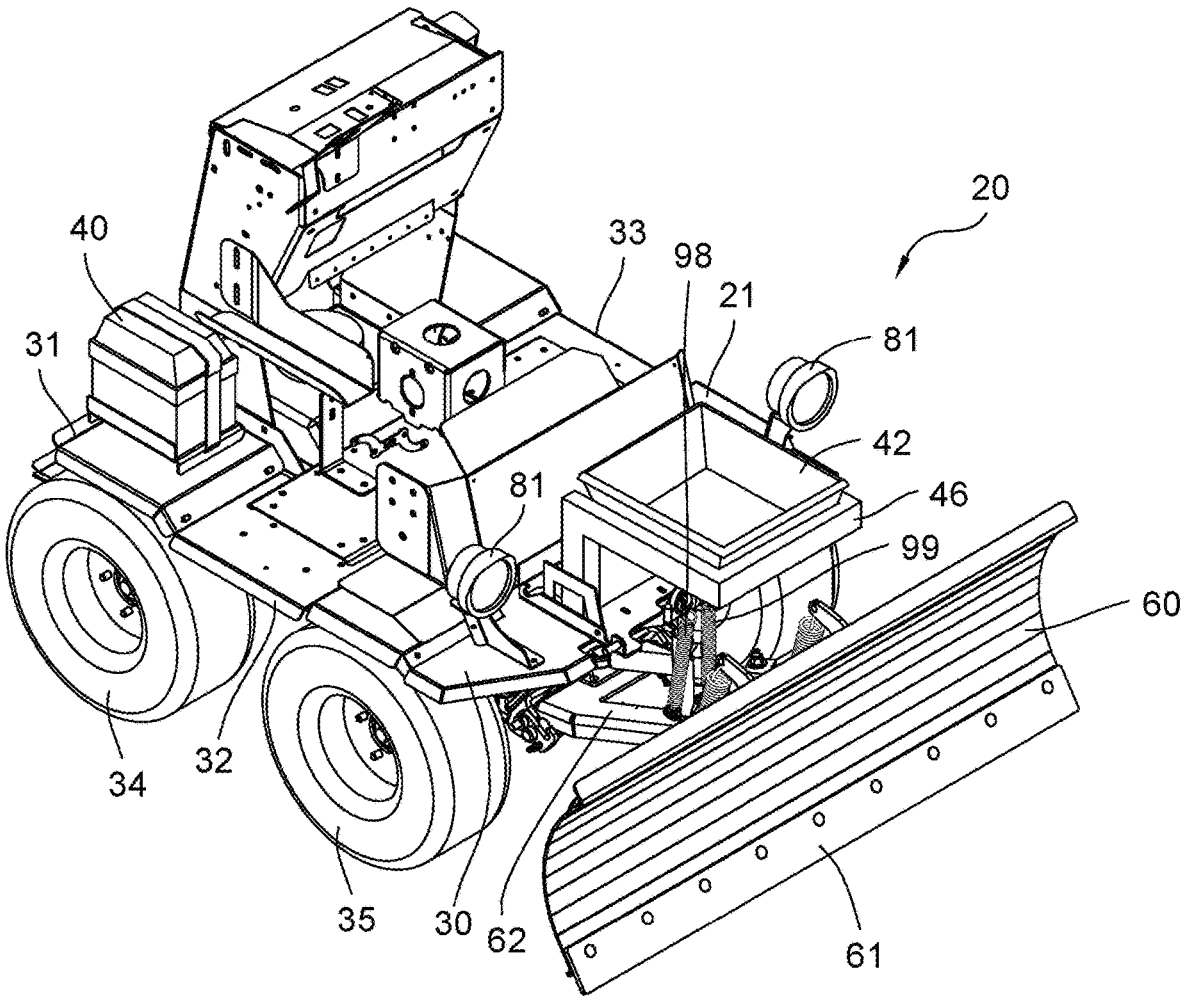
FIG. 1 is a front perspective view of a tractor having a snow blade and mounting arrangement for coupling to the tractor.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 7:
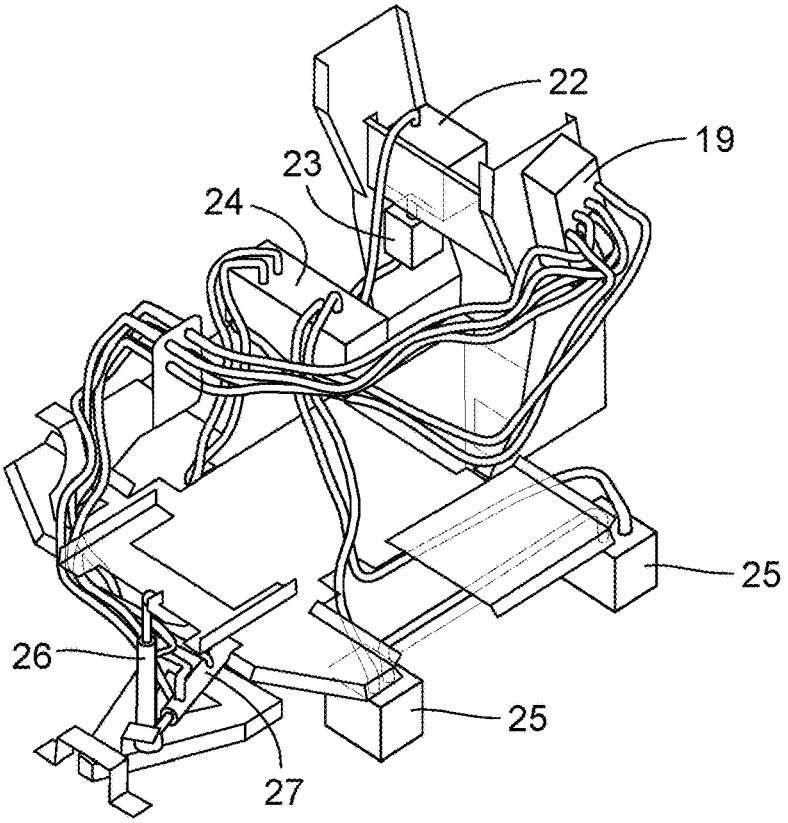
FIG. 7 is a schematic diagram illustrating the source of hydraulic pressure coupled to the cylinders for moving the vehicle wheels and the snow blade.

Referring to the drawings, there is shown a commercially available tractor 20, such as, BOBCAT® available from Clark Equipment Company, that can be utilized with my new snow blade and new mounting structure for coupling the blade to the tractor as well as my spreader for spreading material, such as salt, and my spray system for dispensing liquid for melting the snow and ice beneath the tractor. Such a tractor has an internal combustion engine for providing power along with a four wheel drive with a skid steer transmission for independently driving each of the four wheels rotatably mounted to the vehicle frame 21. The hydraulic system (FIG. 7) is well known in the art and is used to control movement of the tractor 20.

Figure 2:
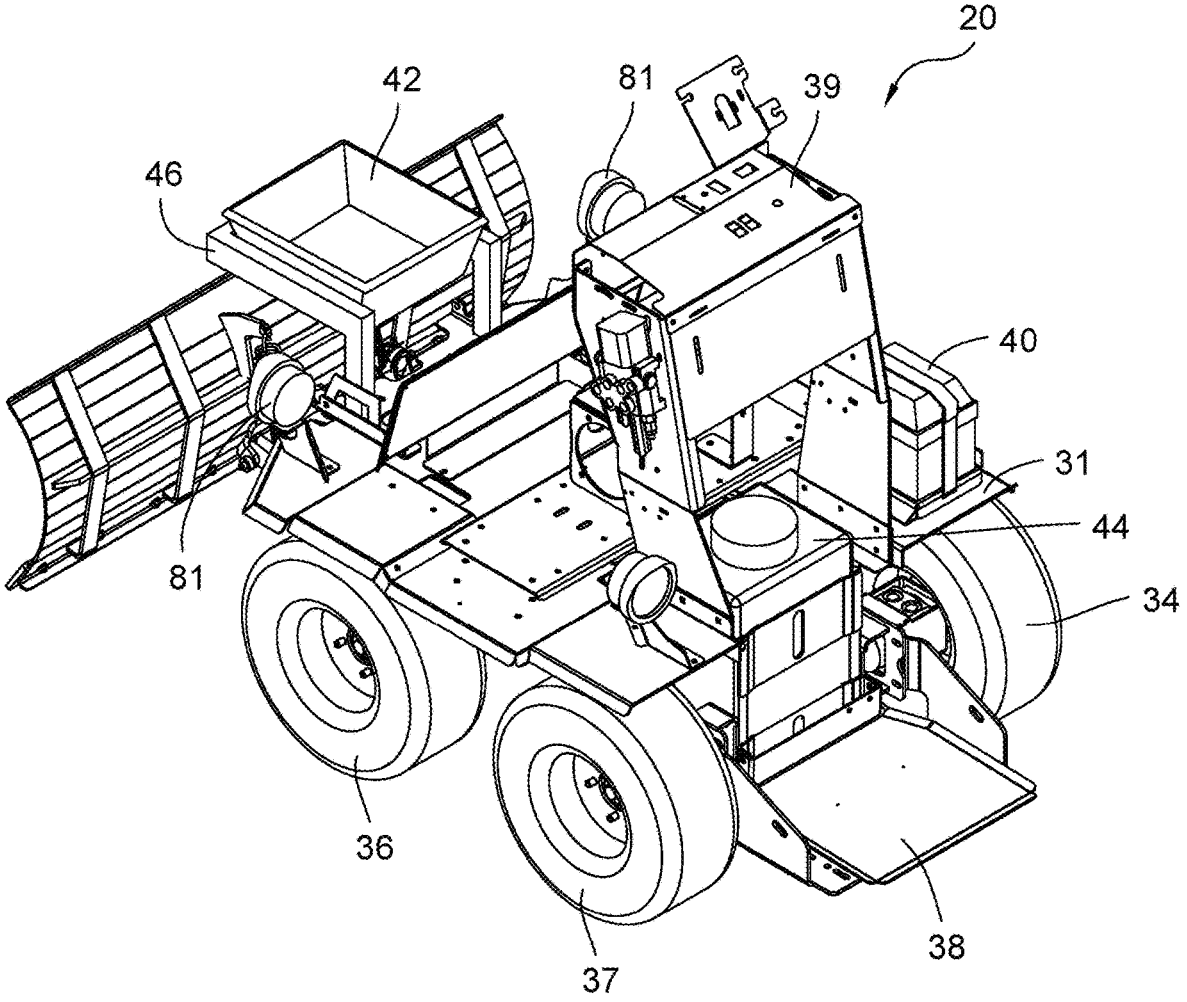
FIG. 2 is a top rear perspective view thereof.

The vehicle frame 21 has a front end 30 and rear end 31 with the right side 32 of the vehicle frame as viewed looking from rear end 31 towards front end 30 and a left side 33. The two sides 32 and 33 extend from the rear end 31 forward to the front end 30. Two wheels 34 and 35 are rotatably mounted by conventional means to the right side of frame 21 along with a pair of opposite wheels 36 and 37 (FIG. 2) mounted to the left side of the vehicle frame. A platform 38 is mounted to the rear end 31 of the vehicle frame to allow the operator to stand thereon and control the various joy sticks and switches mounted to control panel 39. The two rear wheels 37 and 34 located at the rear end of the vehicle frame along with the two front wheels 35 and 36 support the vehicle atop a supporting surface, such as, a path, driveway or other relatively narrow way. Lights 81 are mounted to the front and rear of the vehicle frame.

A tank 22 (FIG. 7) of hydraulic fluid is coupled to filter 23 by a conventional fluid hose. Both are coupled to a conventional direct drive hydraulic pump 24, in turn, coupled separately to wheel motors 25 with a separate wheel motor mounted to each one of the four wheels. Valves 19 are coupled to pump 24 enabling the operator to individually control the operation of each wheel motor and the resultant rotation of the wheel attached to each particular motor. Such a commercially available tractor thereby allows the operator to keep the wheels on one side of the tractor motionless while the wheels on the opposite of the tractor are rotated providing a very small turning radius for the tractor.

Figure 6:
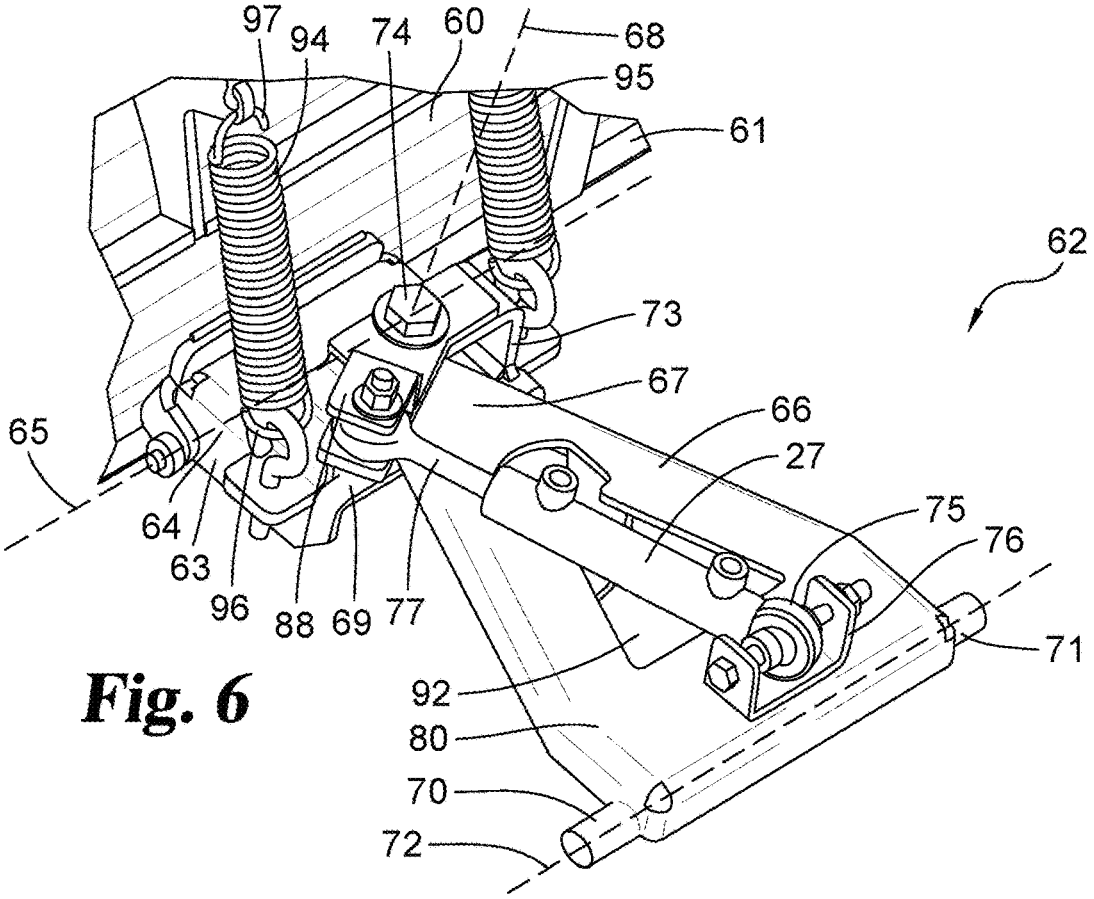
FIG. 6 is an enlarged fragmentary perspective top view of the snow blade and associated mounting structure attached thereto with cylinder 26 not shown.

My new snow plow with mounting structure includes two hydraulic cylinders 26 and 27 (FIGS. 6 & 7) mounted at the front end of the vehicle frame for controlling movement of the snow blade attached thereto. Hydraulic cylinder 26 has not been shown in FIG. 6 to more clearly illustrate the bracketry forming the blade mount. Hydraulic cylinders 26 and 27 are connected via hydraulic lines to valves 19 enabling the operator to control the extension and retraction of the piston rods associated with cylinders 26 & 27.

Figure 3:
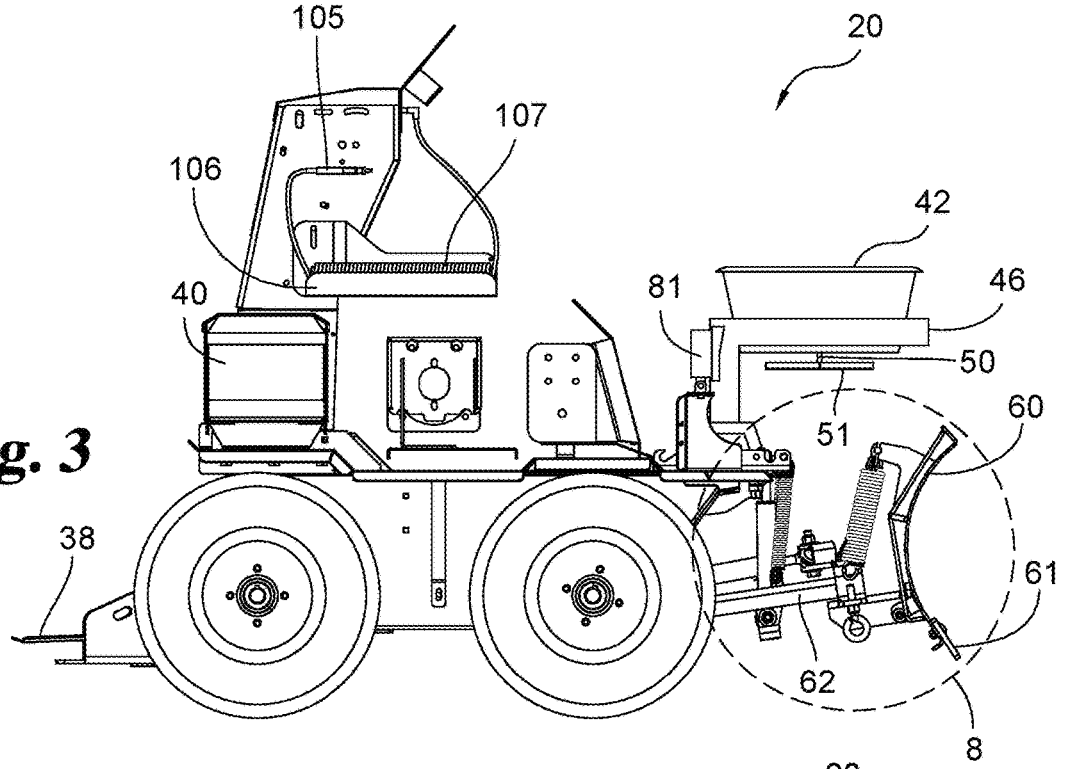
FIG. 3 is a right side view thereof.
Figure 8:
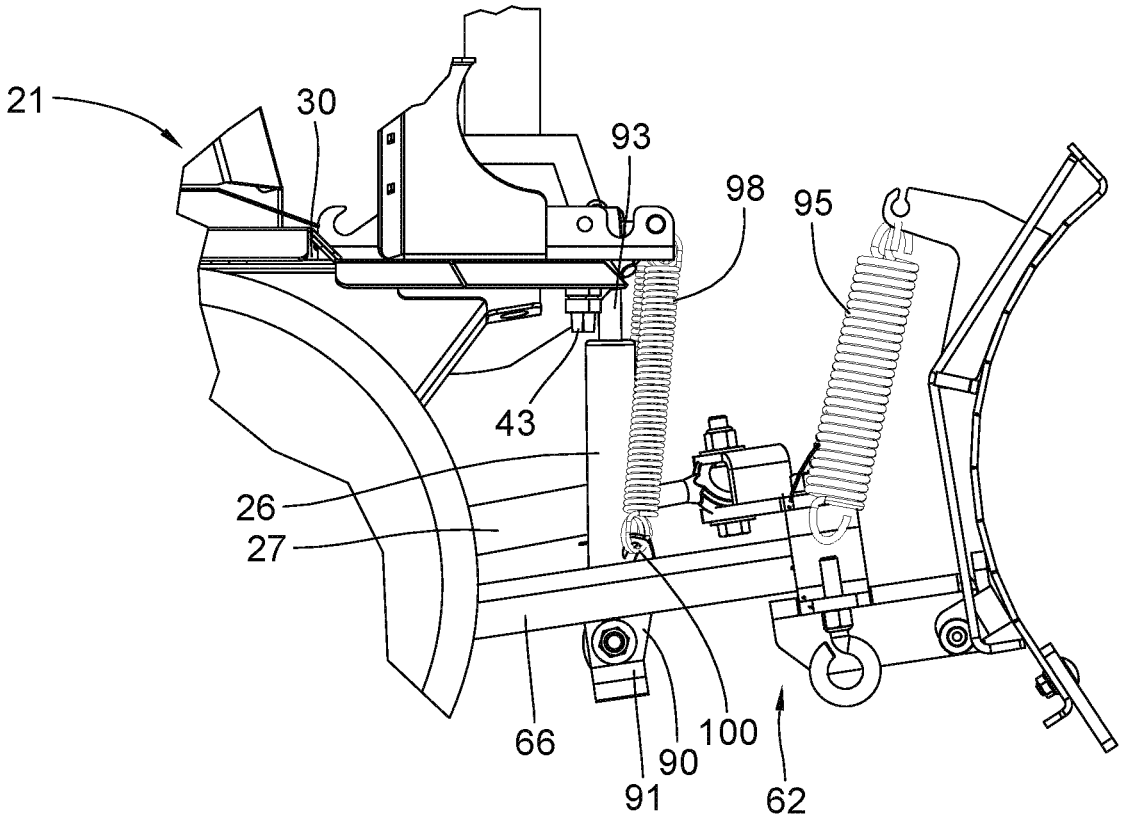
FIG. 8 is an enlarged fragmentary view of the front of the tractor shown in the area contained in circle 8 of FIG. 3 illustrating a liquid deicer nozzle and a hydraulic lift cylinder mounted thereto.

A standard battery 40 (FIG. 2) is mounted atop the vehicle frame at the rear end 31 thereof along with a 20 gallon tank 44 of liquid deicer that is routed via a conventional hose to a plurality of conventional spray nozzles 43 (FIG. 8) mounted at the front end 30 of vehicle frame 21 in front of each of the front wheels. In one embodiment, two nozzles 43 are positioned above each of the front wheels for a total of four nozzles. In addition, there is a hand held wand 105 (FIG. 3) removably positioned in cradle 106 with the wand having a nozzle connected by hose 107 to tank 44 of deicer fluid. Wand 105 includes a hand movable lever to control the fluid from the wand. In the preferred embodiment, the liquid flow to the nozzles is controlled by valves 19.

Figure 4:
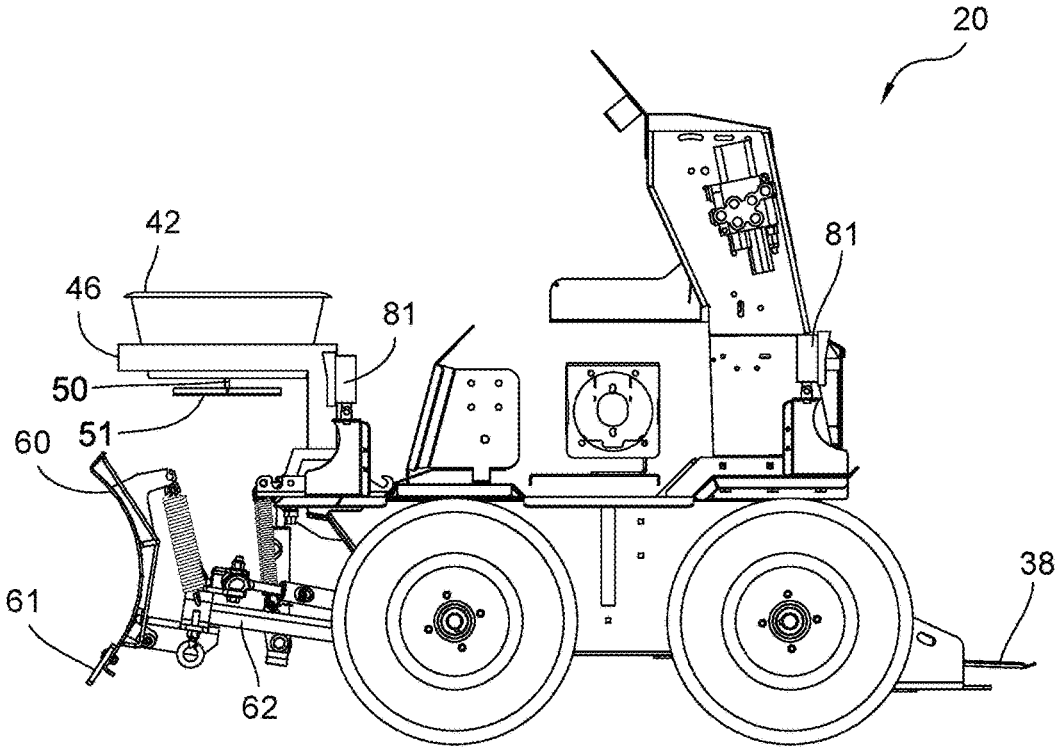
FIG. 4 is a left side view thereof.

A container 42 (FIG. 1) for holding salt or other solids to be spread atop the snow and ice is mounted to a platform 46, in turn, mounted atop vehicle frame 21 at the front end 30 of the vehicle frame. The bottom of container 42 has an opening that may be opened and closed to allow a controlled amount of salt or other solid materials to fall downwardly atop a four armed spreader wheel 51 (FIG. 4) rotatably mounted and driven by axle 50 so that the salt or other material may fall downwardly in a scattered form in front of the front wheels 35 and 36. In the preferred embodiment, a manually operated cable attached to the door extending over the opening in the bottom of container 42 is provided to control the opening and closing of the container. The rotation of the spreader wheel 51 may be controlled by a motor connected to the spinner axle 50.

Snow blade 60 (FIG. 4) has a concave configuration as viewed from in front of the tractor and blade with the bottom edge 61 movable to and from the snow and ice atop the surface supporting the vehicle.

A compound snowblade mount 62 (FIG. 4) provides a blade mounting means for mounting the snow plow blade to the front end of the vehicle frame and is operable to move the blade to multiple positions including a down position locating the blade against the supporting surface to plow snow, an upward transport position locating the blade apart from the supporting surface and a float position to allow the blade to float upward and downward. Further, the blade mount is operable to angle snow blade 60 angularly relative to the left side of the vehicle as viewed from the operator's standpoint and further to position the blade angularly towards the right side of the vehicle frame to push the snow toward the right side of the vehicle frame.

Figure 5:
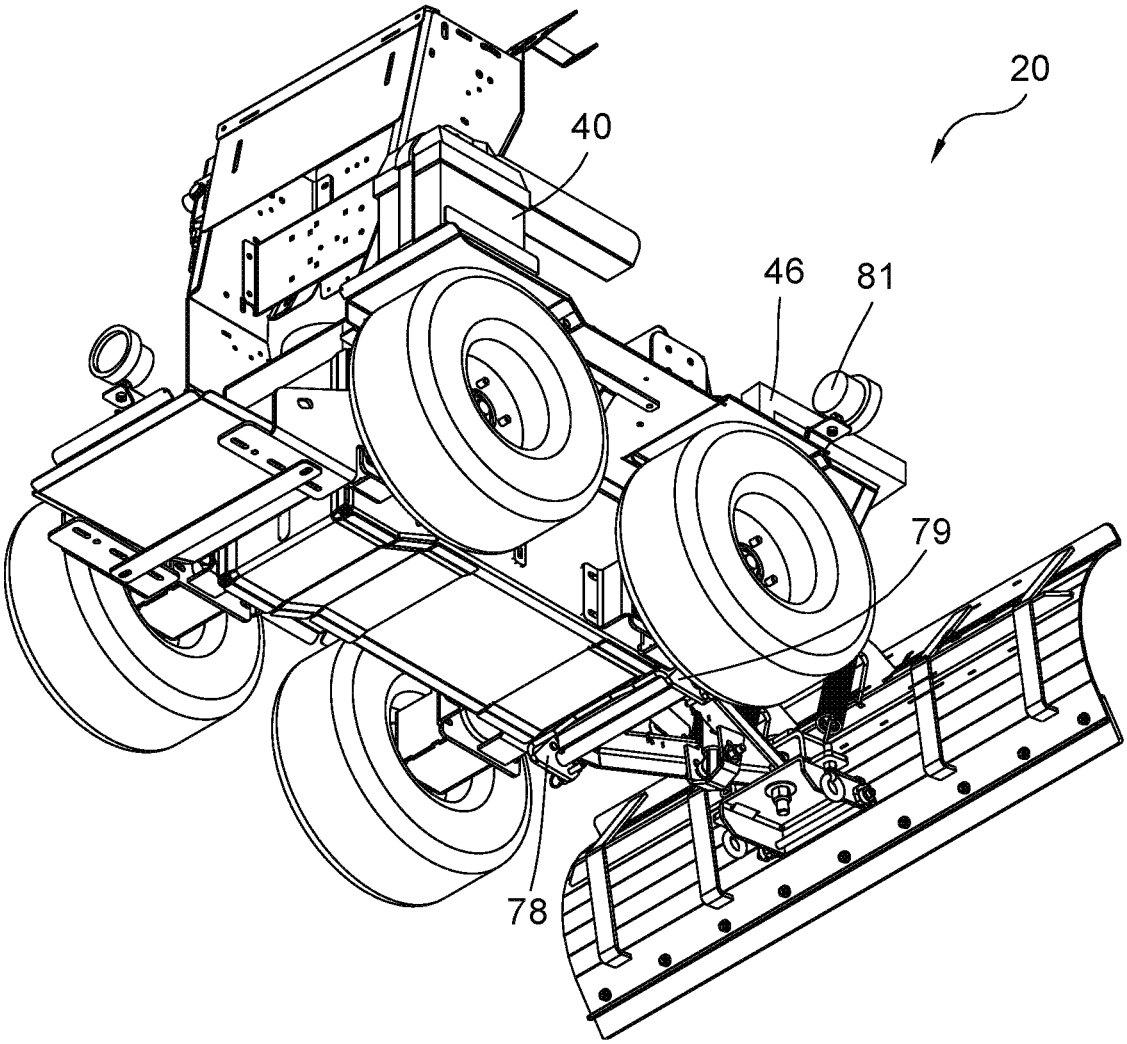
FIG. 5 is a bottom perspective view thereof.

Snowblade mount 62 (FIG. 6) has an outer portion 63 and an inner portion 66 pivotally connected together. The distal end 64 of the outer portion 63 is pivotably mounted about horizontal axis 65 to a pair of ears fixedly mounted to the rearwardly facing surface of blade 60. The inner portion 66 of the snowblade mount has a distal end 67 pivotably connected about a vertical axis 68 to the proximal end 69 of the outer portion 63 of the mount. The distal end 67 extends into an inverted u-shaped bracket 73 mounted atop the outer portion 63 of the mount with a bolt 74 extending through bracket 73 and the distal end 67 of the inner portion of the mount allowing the outer portion to pivot about vertical axis 68. The proximal end 80 of the inner portion 66 has a pair of opposite arms 70 and 71 extending in the direction of horizontal axis 72 that are rotatably received by a pair of brackets 78 & 79 (FIG. 5) allowing the blade to pivot about axis 72. The mount 62 therefore pivots about a horizontal axis 72 while the outer portion 63 of the mount pivots about a vertical axis 68 and the blade 60 pivots about a horizontal axis 65. Hydraulic cylinders 26 and 27 control the movement. Cylinder 26 is not shown in FIG. 6 in order to show the remaining components of the blade mount 62.

Yaw hydraulic cylinder 27 (FIG. 6) controls movement of the snow blade at an angle to the left or right side of the vehicle in order for the blade to push the snow to the left or right of the vehicle. Cylinder 27 has a first end 75 movably mounted to an upwardly opening u-shaped bracket 76 mounted to the proximal end 80 of the inner portion 66 of blade mount 62. The opposite end of hydraulic cylinder 27 is the outer end of piston rod 77 that is movably mounted to bracket 88 in turn fixedly mounted to the outer portion 63 of the blade mount. In the preferred embodiment, the longitudinal axis of hydraulic cylinder extends centrally through piston rod 77 with the outer end of rod 77 being to one side of vertical axis 68 that extends centrally through bolt 74. The opposite end 75 of the cylinder is located on the opposite side of axis 68. Extension of rod 77 results in movement of outer portion 66 and blade 60 toward one side of the vehicle whereas retraction of rod 77 results in movement of outer portion 66 and blade 60 toward the other side of the vehicle with the outer portion 66 pivoting about vertical axis 68.

Pitch hydraulic cylinder 26 controls vertical movement of the snow blade to position the blade in the down position against the pavement or other supporting surface, to the upward transport position locating the blade apart from the supporting surface, and to the float position to allow the blade to float vertically. Cylinder 26 (FIGS. ? & 8) has a cylinder housing with a bottom end 90 mounted to a bracket 91 fixed to the bottom of the inner portion 66 of blade mount 62. The cylinder housing extends through an opening 92 (FIG. 6) with the top end 93 (FIG. 8) of the piston rod fixed to the vehicle frame. Thus, extension and retraction of the piston rod results in the lowering and raising of the inner portion 66 and outer portion along with the snow blade.

A pair of helical springs 94 and 95 (FIGS. 6 & 8) have bottom ends 96 fixed to the outer portion 63 of the blade mount and top ends 97 fixed to the snow blade. The springs are yieldable to allow the blade to pivot clockwise as viewed in FIG. 8 in case the blade encounters a stone or other object on the path with the springs then returning the blade to its normal positon.

A pair of helical springs 98 and 99 (FIGS. 1 & 8) have top ends fixed to the vehicle frame and extend downward having bottom ends 100 fixed to the inner portion 66 of the blade mount. The springs allow the blade mount with blade to move downward but normally urge the blade mount with blade upward.

Operation of the hydraulic cylinders 26 and 27 is controlled by a joy stick in turn coupled to the valves 19 controlling the flow of hydraulic fluid pressure to cylinders 26 and 27. The Joystick has five positions of operation. Pulling back on the Joystick will raise the blade to the up position (off the ground for transport of transition). Pulling the Joystick to the left angles the blade to the left allows the vehicle to push the snow to the left whereas pulling the Joystick to the rights angles the blade to the right allows the vehicle to push the snow to the right. Pushing the Joystick forward to the first forward position from center lowers the blade with down-force pressure for plowing whereas pushing the Joystick to the second forward position gives float to the blade between the downward and upward positions.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. While a snow blade is shown mounted to the vehicle, it is understood that other devices may be substituted for the blade.

What is claimed is:

1. A snow removal system comprising:

a skid steer vehicle comprising:

a frame having a frame front end, a frame rear end, a first side, and a second side, a power source, at least one ground engaging element positioned adjacent the first side of the frame, and at least one ground engaging element positioned adjacent the second side of the frame, a standing platform positioned rearward of at least a portion of the power source, and an operator control panel comprising controls operatively connected to the power source to independently control the at least one ground engaging element positioned adjacent the first side of the frame and the at least one ground engaging element positioned adjacent the second side of the frame; and a mount configured to removably connect a snow removal accessory to the frame, the mount comprising:

a mount rear end connected to the frame and pivotable about a first substantially horizontal axis, wherein the mount rear end connects to the frame at least a location which is rearward of at least a portion of at least one of the ground engaging elements and forward of at least a portion of the operator control panel, a mount front end positioned at least partially in front of the frame front end, and wherein the first substantially horizontal axis is positioned in front of at least a portion of the operator control panel and lower than at least a portion of the at least one ground engaging element positioned adjacent the first side of the frame.

2. The snow removal system of claim 1, further comprising the snow removal accessory.

3. The snow removal system of claim 1, further comprising a hydraulic motor attached to the frame and operatively connected to the power source and the at least one ground engaging element positioned adjacent the first side of the frame.

4. The snow removal system of claim 2, wherein the snow removal accessory is a plow.

5. The snow removal system of claim 4, the plow further comprising a blade and at least one spring attached to the blade, wherein at least a portion of the blade is configured to pivot about a second substantially horizontal axis.

6. The snow removal system of claim 5, wherein the at least one spring allows the at least a portion of the blade to pivot about the second substantially horizontal axis in response to an encountered object.

7. The snow removal system of claim 1, further comprising an accessory platform mounted to the frame.

8. The snow removal system of claim 7, wherein the accessory platform comprises an L-shaped frame.

9. The snow removal system of claim 7, wherein a chemical applicator is mounted to the accessory platform.

10. The snow removal system of claim 9, wherein the chemical applicator is a salt spreader.

11. The snow removal system of claim 1, wherein at least a portion of the mount rear end is positioned between the first and second sides of the frame.

12. The snow removal system of claim 1, comprising a front rotatable element positioned adjacent the first side of the frame and a rear rotatable element positioned adjacent the first side of the frame, wherein the mount rear end is connected to the frame at least at a location which is rearward of at least a portion of the front rotatable element.

13. The snow removal system of claim 12, wherein the first substantially horizontal axis passes through the front rotatable element.

14. The snow removal system of claim 12, wherein at least a portion of the front rotatable element is positioned in front of the frame front end.

15. A snow removal system comprising:

a skid steer vehicle comprising:

a frame having a frame front end, a frame rear end, a first side, and a second side, a power source, at least one ground engaging element positioned adjacent the first side of the frame, and at least one ground engaging element positioned adjacent the second side of the frame, a standing platform positioned rearward of at least a portion of the power source, and an operator control panel with controls operatively connected to the power source to independently control the at least one ground engaging element positioned adjacent the first side of the frame and the at least one ground engaging element positioned adjacent the second side of the frame; and a mount configured to removably connect a snow removal accessory to the frame, the mount comprising:

a mount rear end connected to the frame and pivotable about a first substantially horizontal axis, a mount front end positioned at least partially in front of the frame front end, wherein at least a portion of the mount rear end is positioned between the first and second sides of the frame and rearward of at least a portion of the at least one ground engaging element positioned adjacent the first side of the frame, and wherein the first substantially horizontal axis is positioned in front of the operator control panel and lower than the at least a portion of the at least one ground engaging element positioned adjacent the first side of the frame.

16. The snow removal system of claim 15, further comprising:

a hydraulic pump;

a first hydraulic motor in operable communication with the hydraulic pump to control movement of the at least one ground engaging element positioned adjacent the first side of the frame;

a second hydraulic motor in operable communication with the hydraulic pump to control movement of the at least one ground engaging element positioned adjacent the second side of the frame; and a first hydraulic cylinder to pivot the mount about the first substantially horizontal axis.

17. The snow removal system of claim 16, further comprising the snow removal accessory.

18. The snow removal system of claim 17, wherein at least a portion of the snow removal accessory is configured to pivot about a substantially vertical axis in response to actuation of a second hydraulic cylinder.

19. The snow removal system of claim 16, wherein the first hydraulic motor and the second hydraulic motor are positioned rearward of at least a portion of the operator control panel.

20. The snow removal system of claim 19, further comprising a liquid deicing system, the deicing system comprising a liquid deicing tank, wherein at least a portion of the liquid deicing tank is positioned rearward of at least a portion of the operator control panel.

21. The snow removal system of claim 20, wherein the liquid deicing tank is positioned adjacent the standing platform.

22. The snow removal system of claim 15, comprising a front rotatable element positioned adjacent the first side of the frame and a rear rotatable element positioned adjacent the first side of the frame, wherein the mount rear end is connected to the frame at least at a location which is rearward of at least a portion of the front rotatable element.

23. The snow removal system of claim 22, wherein the first substantially horizontal axis passes through the front rotatable element.

24. The snow removal system of claim 17, the first hydraulic cylinder comprising a first end attached to the frame and second end attached to the mount, wherein the first end is lower than an uppermost portion of the snow removal accessory at least when the snow removal accessory is in a raised position.

25. The snow removal system of claim 18, wherein the snow removal accessory is configured to pivot about a second substantially horizontal axis.

26. A snow removal system comprising:

a skid steer vehicle comprising:

a frame having a frame front end, a frame rear end, a first side, and a second side, a power source, at least one ground engaging element positioned adjacent the first side of the frame, and at least one ground engaging element positioned adjacent the second side of the frame, a front rotatable element positioned adjacent the first side of the frame and a rear rotatable element positioned adjacent the first side of the frame, a standing platform positioned rearward of at least a portion of the power source, and an operator control panel comprising controls operatively connected to the power source to independently control the at least one ground engaging element positioned adjacent the first side of the frame and the at least one ground engaging element positioned adjacent the second side of the frame; and a mount configured to removably connect a snow removal accessory to the frame, the mount comprising:

a mount rear end connected to the frame and pivotable about a first substantially horizontal axis, a mount front end positioned at least partially in front of the frame front end, wherein the first substantially horizontal axis is positioned in front of at least a portion of the operator control panel and lower than at least a portion of the at least one ground engaging element positioned adjacent the first side of the frame, and wherein the mount rear end is connected to the frame at least at a location which is rearward of at least a portion of the front rotatable element.

27. A snow removal system comprising:

a skid steer vehicle comprising:

a frame having a frame front end, a frame rear end, a first side, and a second side, a power source, at least one ground engaging element positioned adjacent the first side of the frame, and at least one ground engaging element positioned adjacent the second side of the frame, a front rotatable element positioned adjacent the first side of the frame and a rear rotatable element positioned adjacent the first side of the frame, a standing platform positioned rearward of at least a portion of the power source, and an operator control panel with controls operatively connected to the power source to independently control the at least one ground engaging element positioned adjacent the first side of the frame and the at least one ground engaging element positioned adjacent the second side of the frame; and a mount configured to removably connect a snow removal accessory to the frame, the mount comprising:

a mount rear end connected to the frame and pivotable about a first substantially horizontal axis, a mount front end positioned at least partially in front of the frame front end, wherein at least a portion of the mount rear end is positioned between the first and second sides of the frame and rearward of at least a portion of the at least one ground engaging element positioned adjacent the first side of the frame, wherein the mount rear end is connected to the frame at least at a location which is rearward of at least a portion of the front rotatable element, and wherein the first substantially horizontal axis passes through the front rotatable element.

* * * * *